US008365438B2

(12) United States Patent
Choi et al.

(10) Patent No.: US 8,365,438 B2
(45) Date of Patent: Feb. 5, 2013

(54) LAUNDRY DRYER AND METHOD FOR CONTROLLING THE SAME

(75) Inventors: Chul Jin Choi, Changwon-si (KR); Chang Woo Son, Busan (KR); Sang Hun Bae, Changwon-si (KR); Jea Hyuk Wee, Busan (KR); Young Bok Son, Changwon-si (KR); Young Soo Kim, Changwon-si (KR); Dong Hyun Kim, Changwon-si (KR); Chong Ryu, Busan (KR); Dae Bong Yang, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 607 days.

(21) Appl. No.: 12/227,134

(22) PCT Filed: May 23, 2007

(86) PCT No.: PCT/KR2007/002510

§ 371 (c)(1),
(2), (4) Date: Feb. 2, 2009

(87) PCT Pub. No.: WO2007/145432

PCT Pub. Date: Dec. 21, 2007

(65) Prior Publication Data

US 2010/0000117 A1 Jan. 7, 2010

(30) Foreign Application Priority Data

Jun. 12, 2006 (KR) ..... 10-2006-0052574
Jun. 12, 2006 (KR) ..... 10-2006-0052675
Jun. 12, 2006 (KR) ..... 10-2006-0052676

(51) Int. Cl.
*F26B 11/02* (2006.01)
*F26B 3/34* (2006.01)
*F26B 5/04* (2006.01)
*F26B 3/00* (2006.01)

(52) U.S. Cl. ..... 34/603; 34/260; 34/411; 34/343

(58) Field of Classification Search ..... 34/443, 34/380, 260, 411, 603, 329, 343
See application file for complete search history.

(56) References Cited

U.S. PATENT DOCUMENTS 3,913,609 A * 10/1975 Remane ..... 137/322
4,686,189 A * 8/1987 Redikultsev et al. ..... 435/286.5
4,906,337 A * 3/1990 Palmer ..... 202/160
5,307,651 A * 5/1994 Felzer ..... 68/23.5
5,640,946 A * 6/1997 Oslin ..... 126/20
6,161,306 A * 12/2000 Clodic ..... 34/321
6,833,032 B1 * 12/2004 Douglas et al. ..... 134/3
7,325,330 B2 * 2/2008 Kim et al. ..... 34/407

(Continued)

FOREIGN PATENT DOCUMENTS

CN 1118026 3/1996
CN 2252823 4/1997

(Continued)

*Primary Examiner* — Kenneth Rinehart
*Assistant Examiner* — John McCormack
(74) *Attorney, Agent, or Firm* — McKenna Long & Aldridge

(57) ABSTRACT

The present invention relates to a dryer and a method for controlling the same. The dryer includes a selectably rotatable drum (20), a hot air heater (90) for heating air to supply hot air to the drum (20), a steam generator (200) for generating steam to supply the steam to the drum (20), and a water supply source (220) for supplying water to the steam generator, thereby removing wrinkles from clothes, effectively.

24 Claims, 14 Drawing Sheets

U.S. PATENT DOCUMENTS

| | | | | |
|---|---|---|---|---|
| 7,356,945 | B2 * | 4/2008 | Choi et al. | 34/597 |
| 7,396,461 | B2 * | 7/2008 | Bommi et al. | 210/266 |
| 7,487,796 | B2 * | 2/2009 | Imler et al. | 137/614.04 |
| 2004/0112411 | A1 * | 6/2004 | Boykin et al. | 134/28 |
| 2005/0022564 | A1 * | 2/2005 | Kim et al. | 68/12.04 |
| 2005/0133072 | A1 * | 6/2005 | Yoon et al. | 134/58 D |
| 2007/0151312 | A1 * | 7/2007 | Bruce et al. | 68/3 R |
| 2007/0151584 | A1 * | 7/2007 | Omachi et al. | 134/56 D |
| 2007/0283728 | A1 * | 12/2007 | Wong et al. | 68/5 R |
| 2008/0271500 | A1 | 11/2008 | Ahn | |
| 2009/0038481 | A1 * | 2/2009 | Yamamoto et al. | 99/330 |

FOREIGN PATENT DOCUMENTS

| | | | |
|---|---|---|---|
| CN | 1680652 | | 10/2005 |
| CN | 1696384 | | 11/2005 |
| DE | 43 04 532 | A1 | 8/1994 |
| DE | 10-260151 | A1 | 7/2004 |
| DE | 10332656 | A1 | 7/2004 |
| DE | 112006000089 | | 10/2007 |
| EP | 1 048 776 | A2 | 3/2000 |
| EP | 2317004 | A1 | 5/2001 |
| EP | 1 544 345 | A2 | 6/2005 |
| EP | 1 666 655 | A2 | 6/2006 |
| EP | 2295627 | A1 * | 3/2011 |
| FR | 2894995 | A1 * | 6/2007 |
| JP | 06115599 | A * | 4/1994 |
| JP | 2005291692 | A * | 10/2005 |
| KR | 10-2006-0035386 | | 4/2006 |
| KR | 10-2006-0046803 | A | 5/2006 |

* cited by examiner

[Fig. 1]
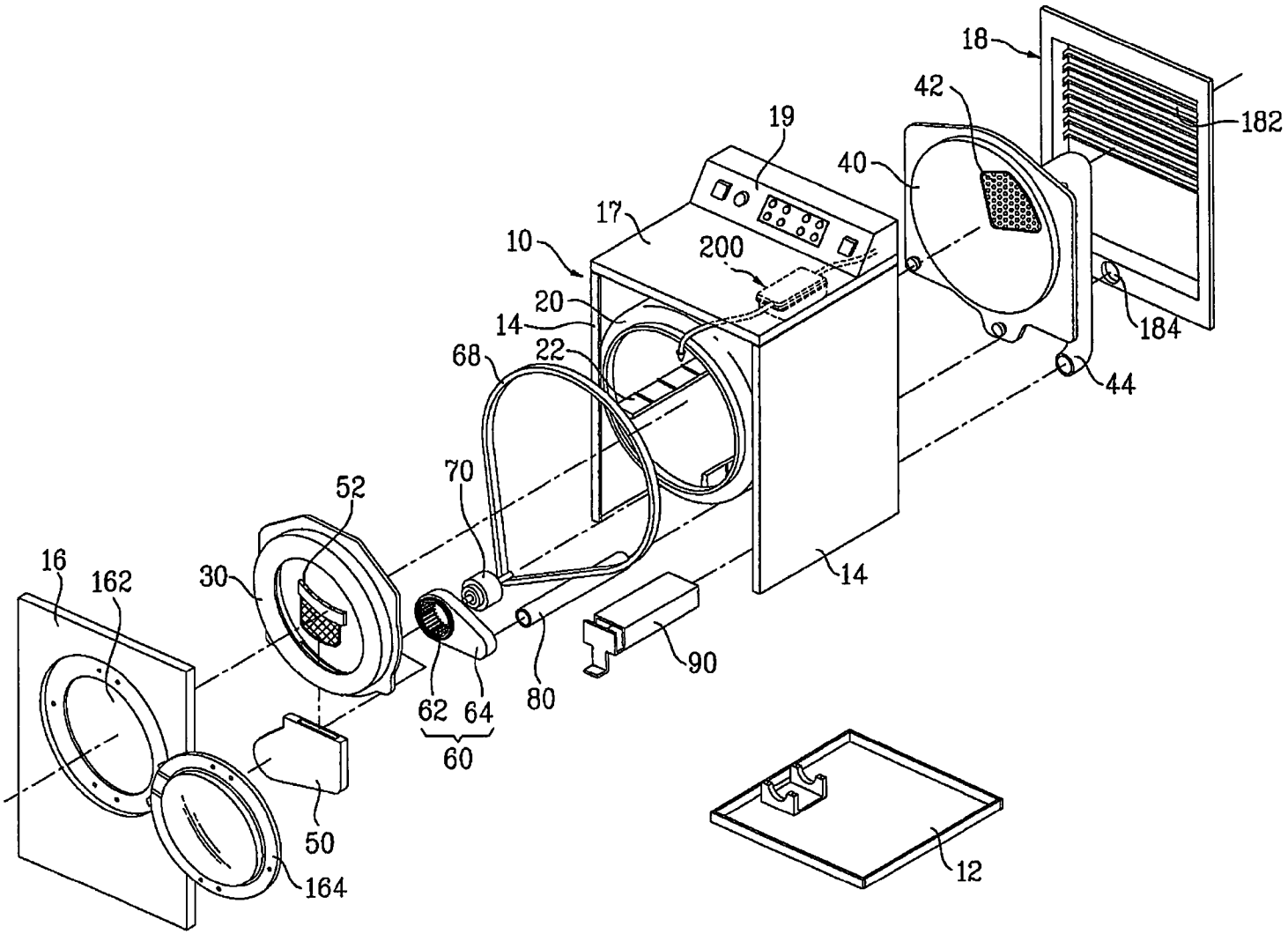

[Fig. 2]
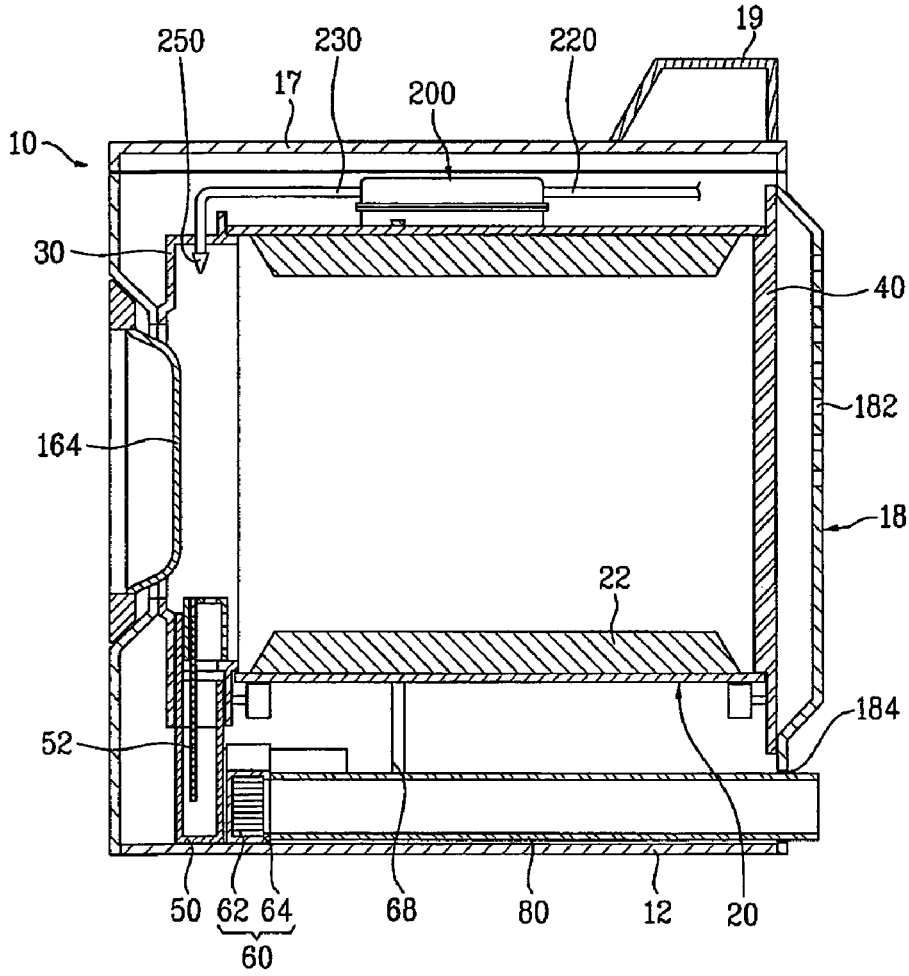
[Fig. 3]
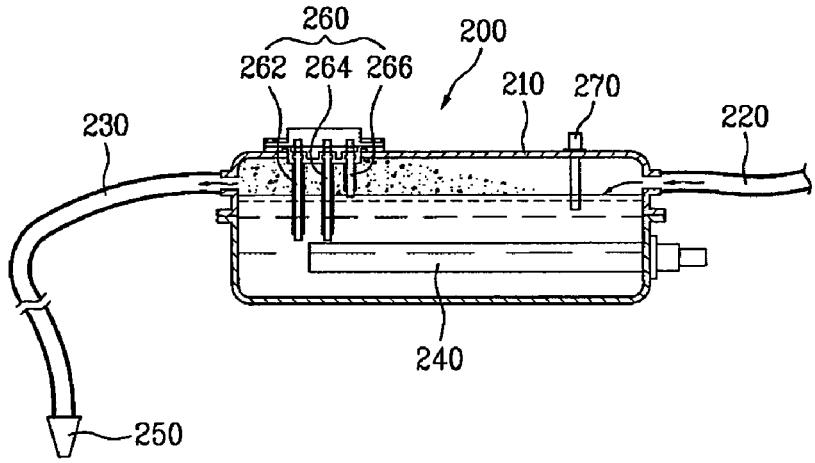

[Fig. 4]
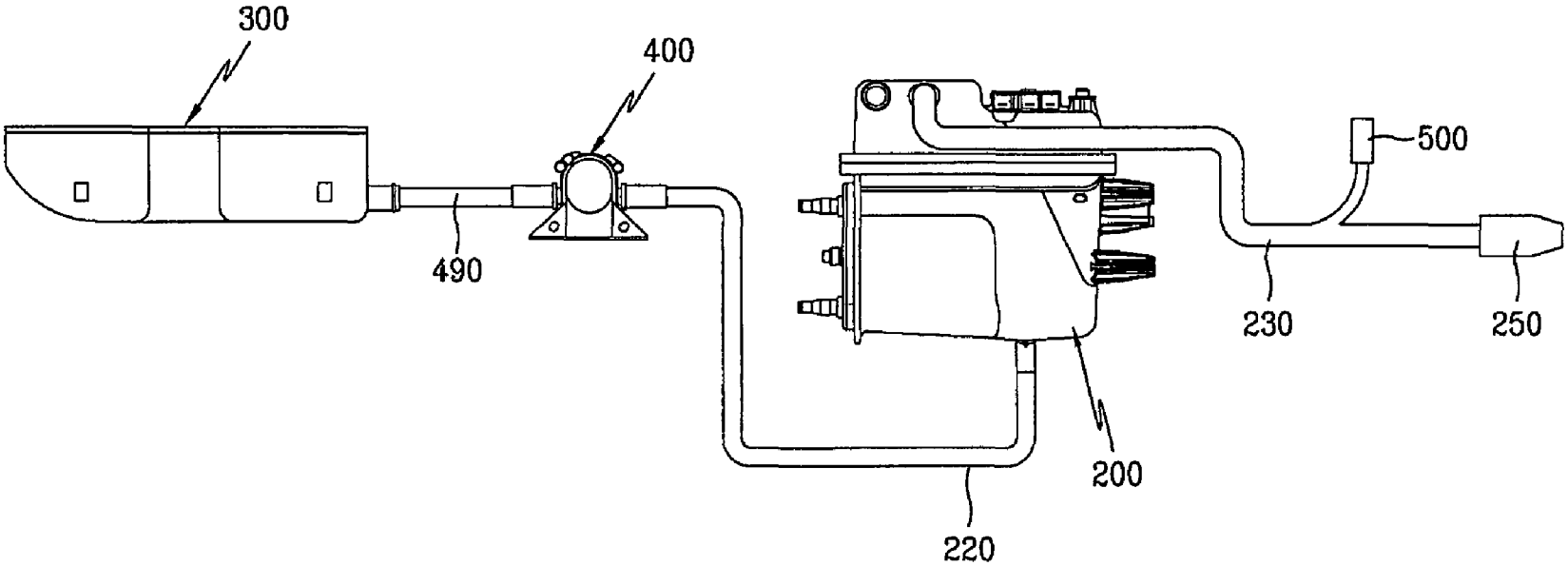

[Fig. 5]
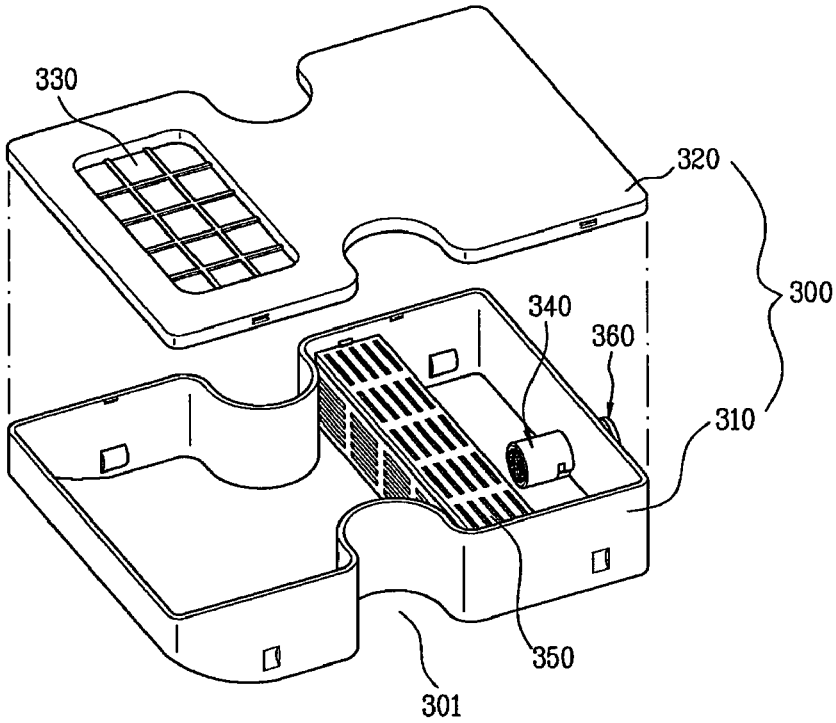
[Fig. 6]
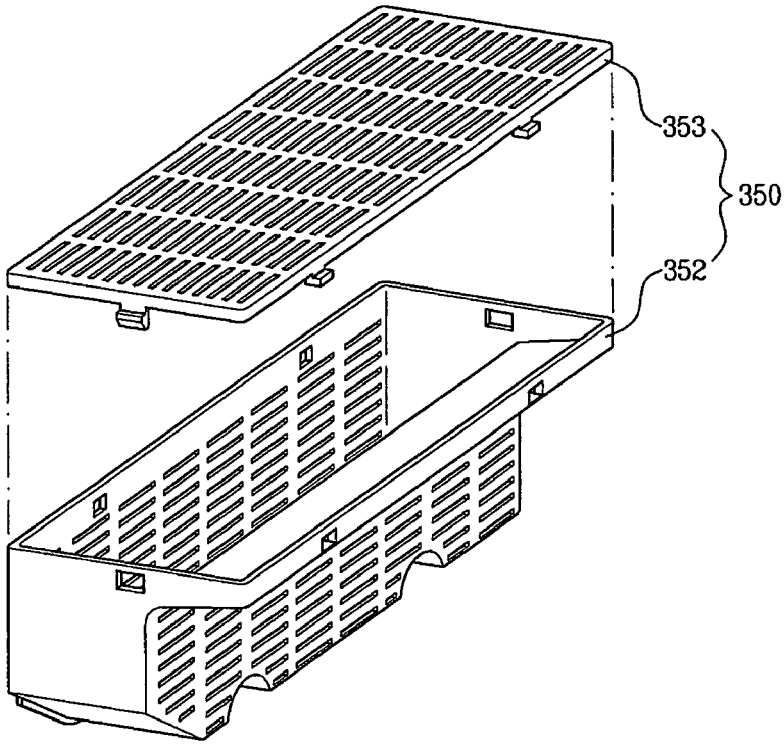

[Fig. 7]
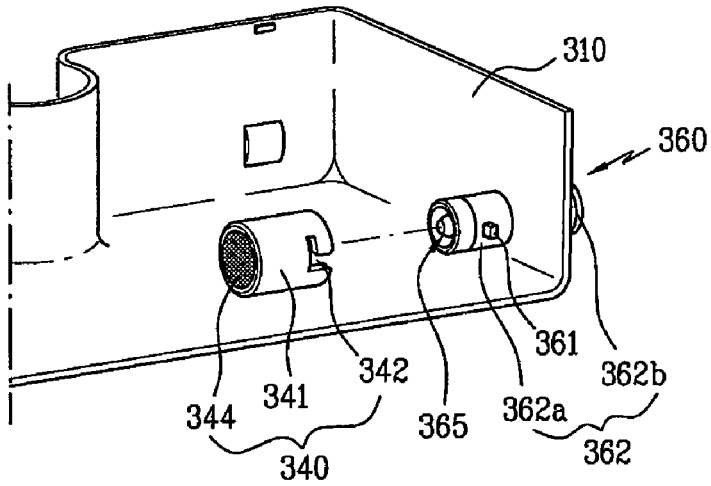
[Fig. 8]
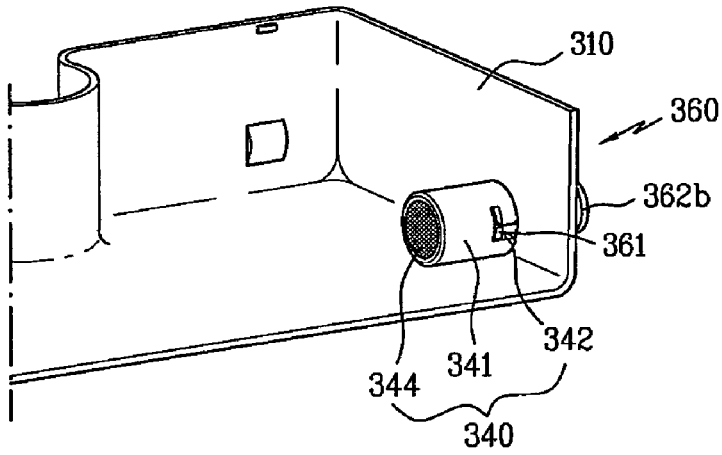
[Fig. 9]
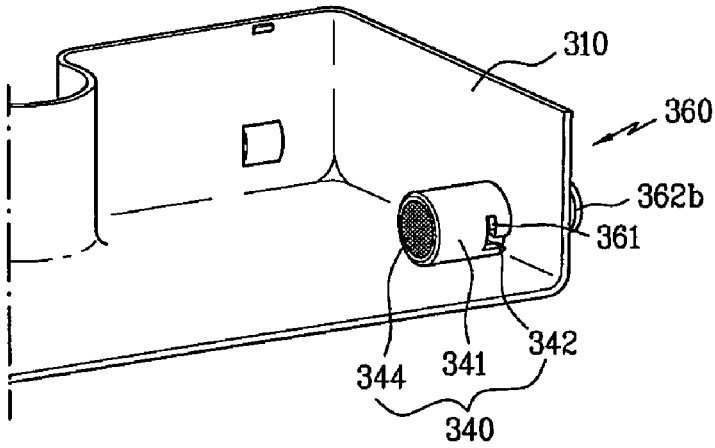

[Fig. 10]
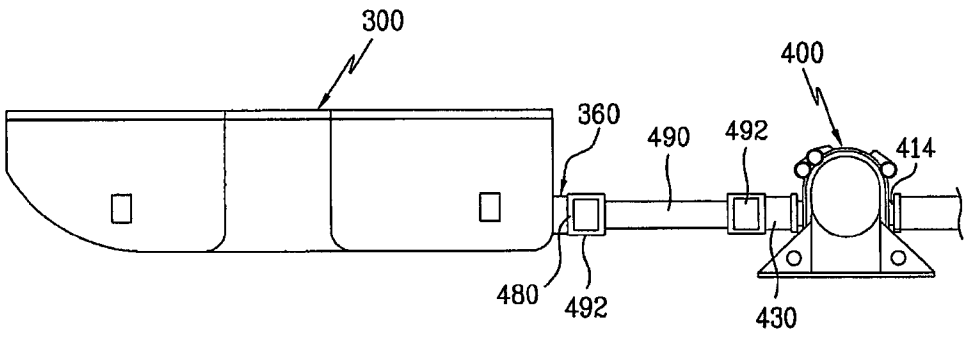
[Fig. 11]
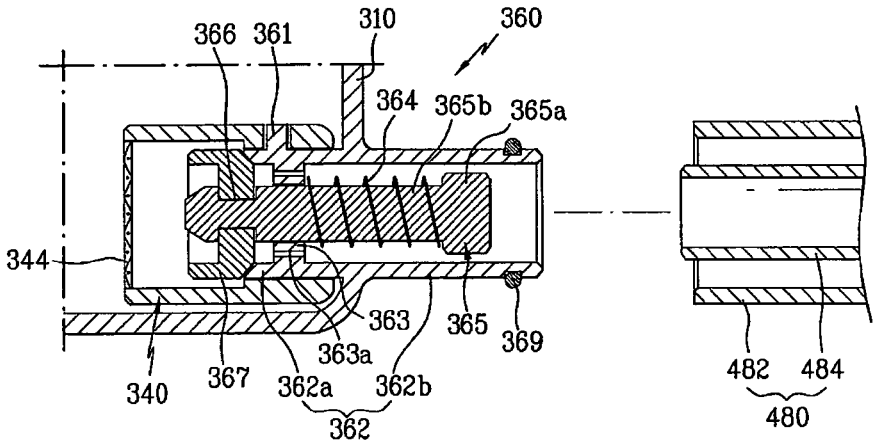

[Fig. 12]
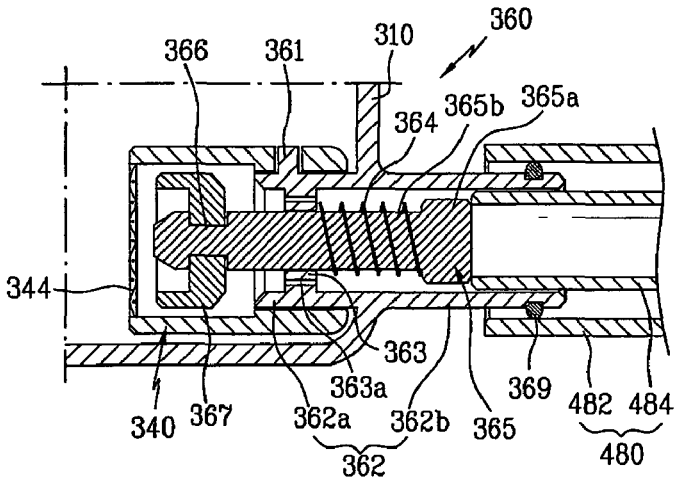
[Fig. 13]
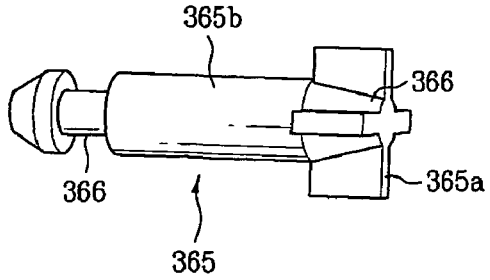
[Fig. 14]
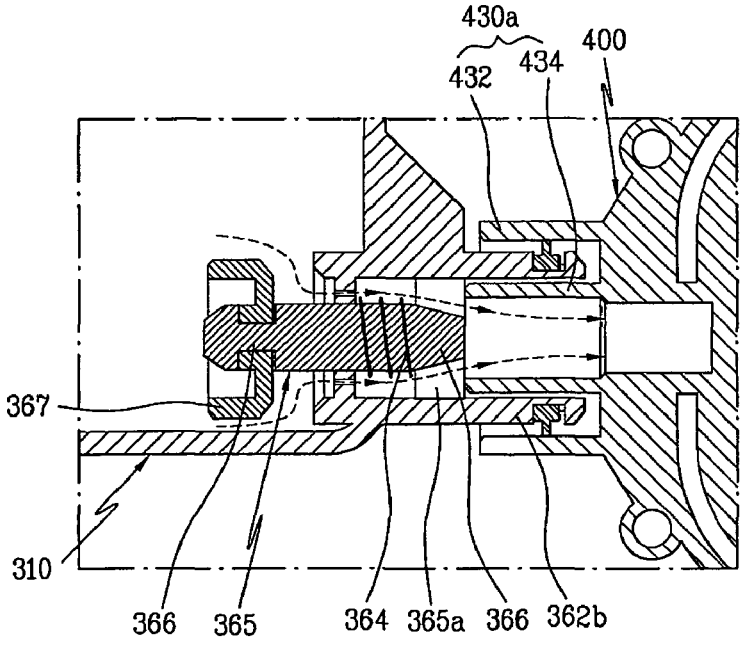

[Fig. 15]
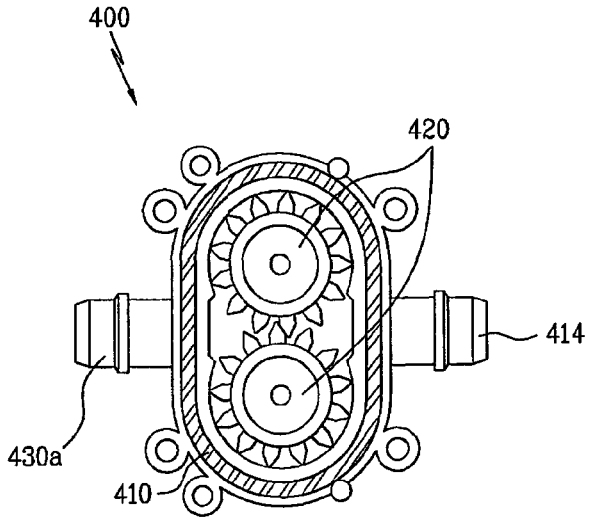
[Fig. 16]
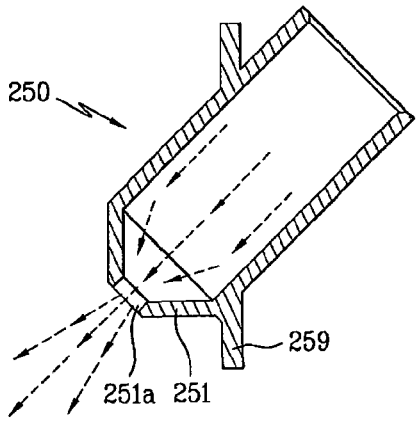
[Fig. 17]
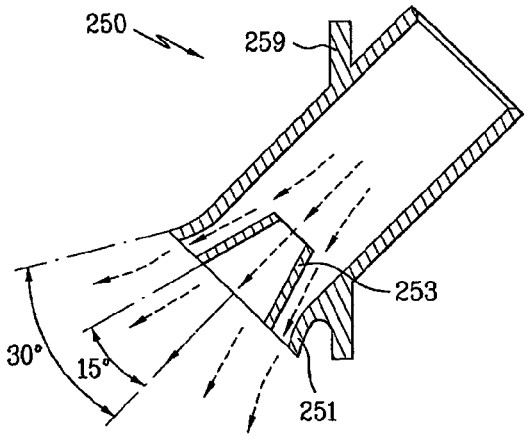

[Fig. 18]
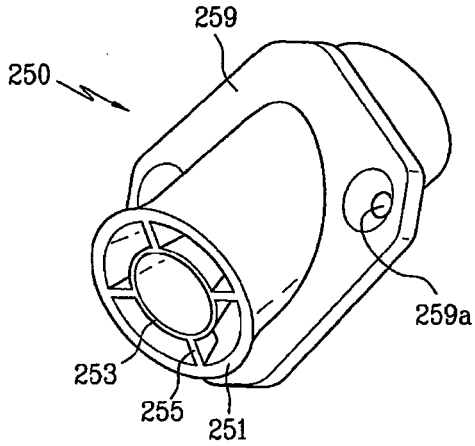
[Fig. 19]
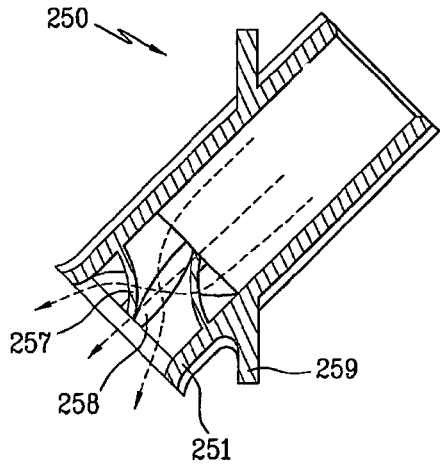
[Fig. 20]
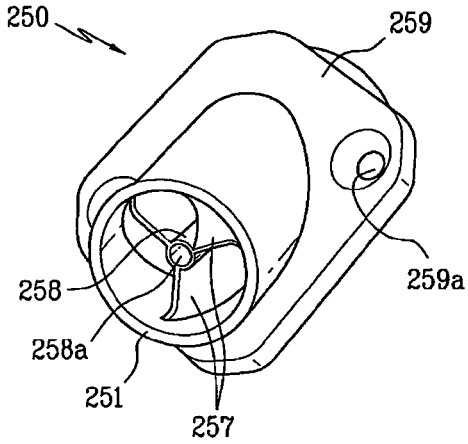

[Fig. 21]
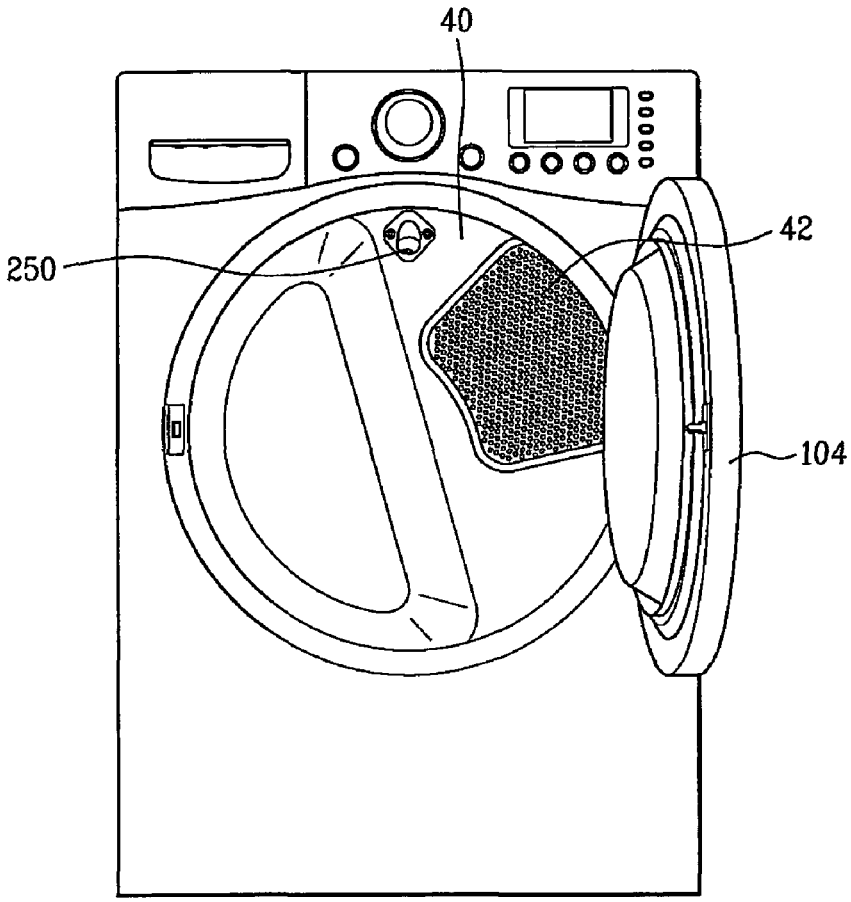
[Fig. 22]
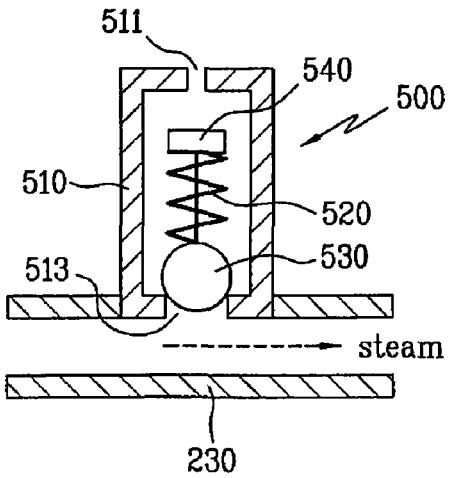

[Fig. 23]
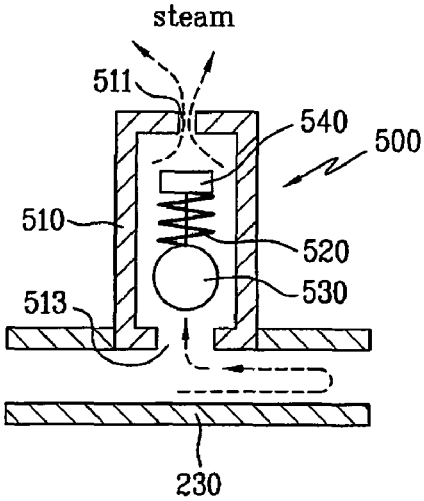
[Fig. 24]
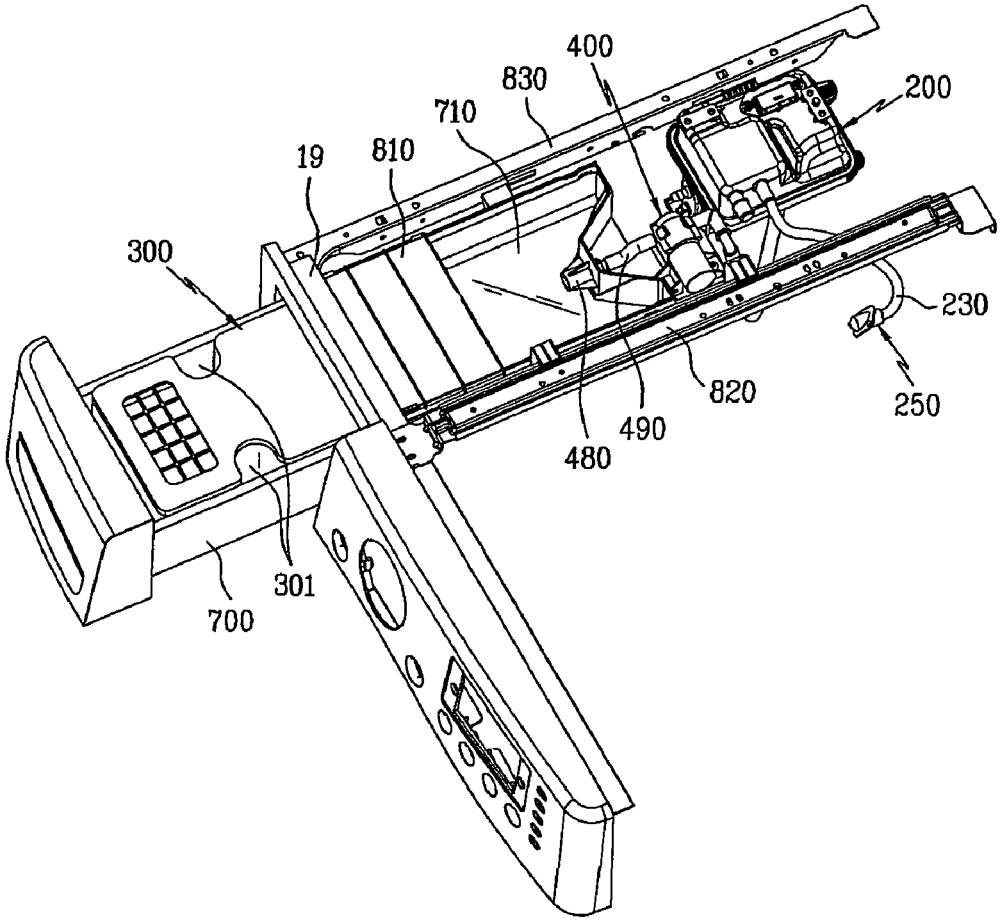

[Fig. 25]
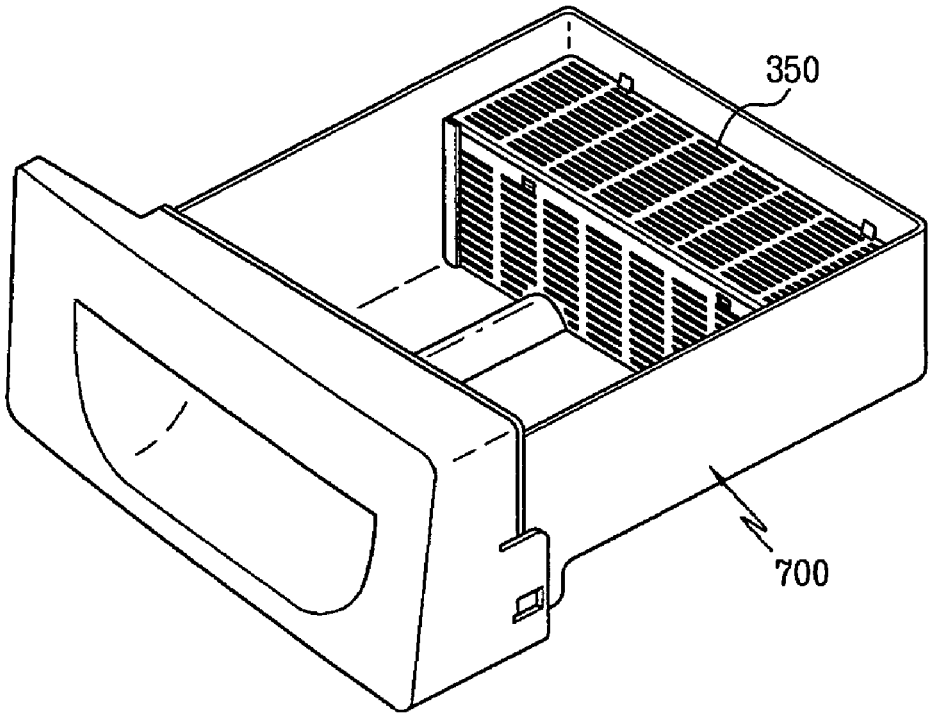

[Fig. 26]
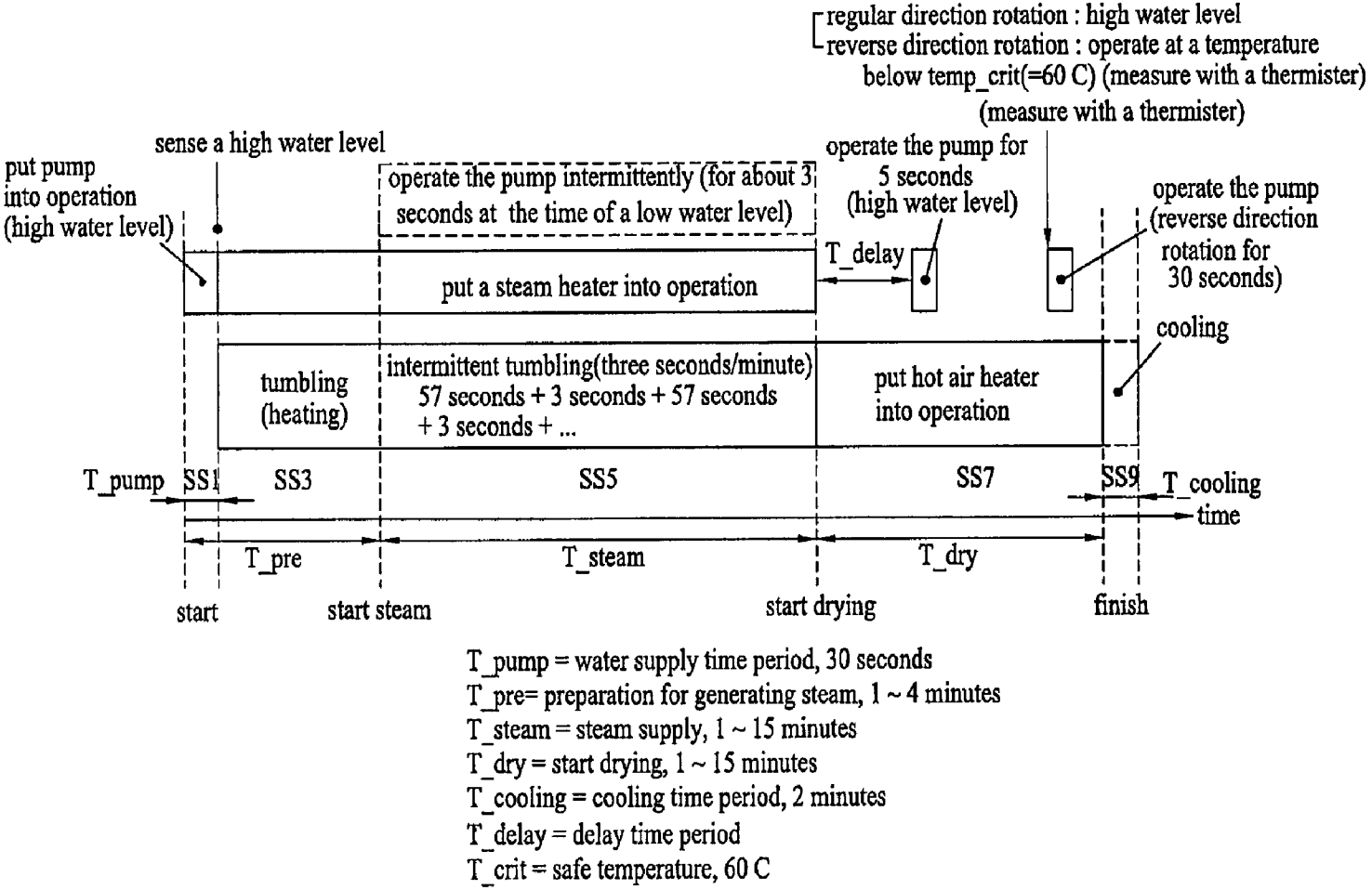

[Fig. 27]
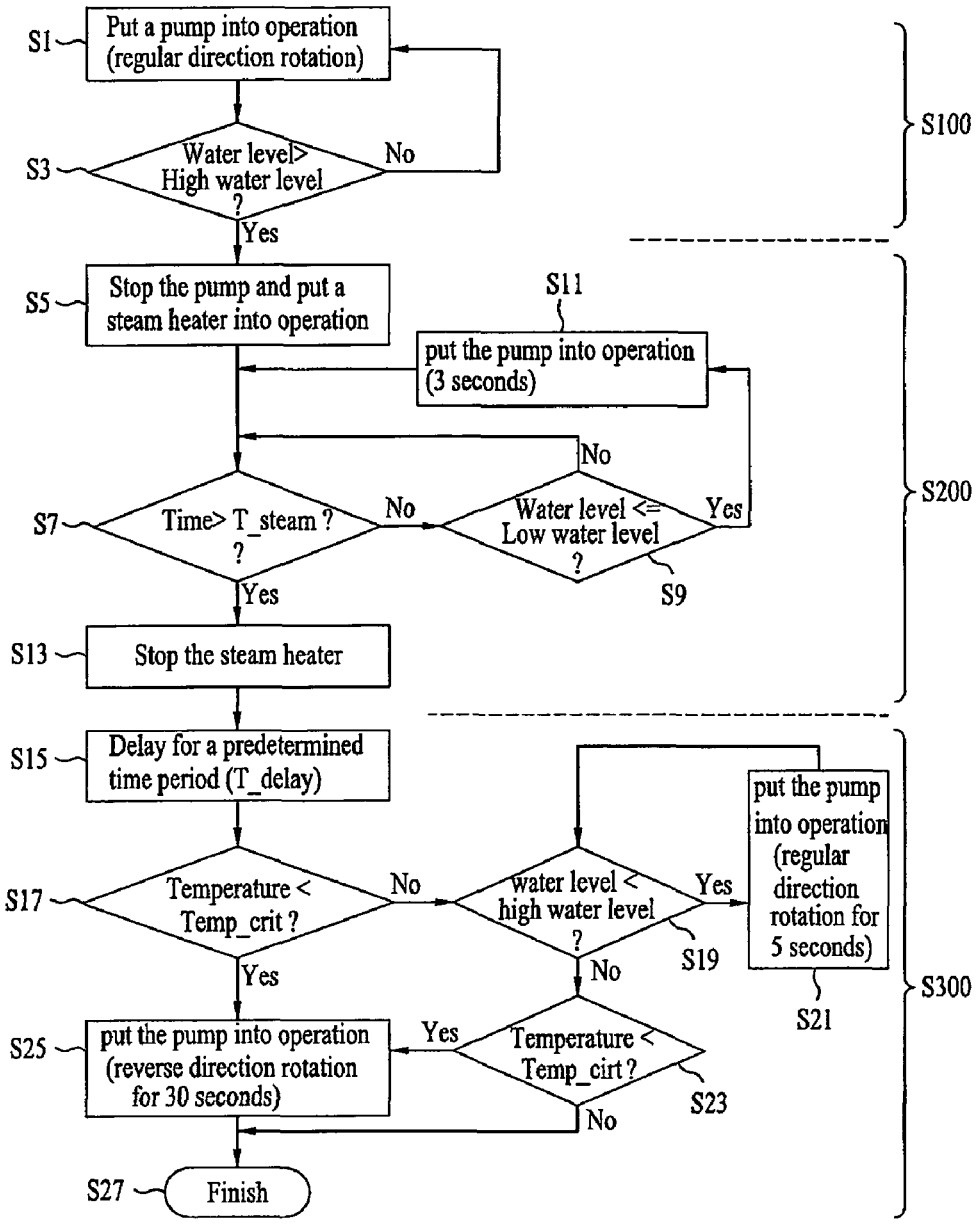

LAUNDRY DRYER AND METHOD FOR CONTROLLING THE SAME

This application is a national stage entry of International Application No. PCT/KR2007/002510, filed May 23, 2007, and claims the benefit of Korean Application Nos. 10-2006-0052574, 10-2006-0052675, and 10-2006-0052676, all filed on Jun. 12, 2006, each of which are hereby incorporated by reference for all purposes as if fully set forth herein.

TECHNICAL FIELD

The present invention relates to a dryer and a method for controlling the same. More specifically, the present invention relates to a dryer using steam and a method for controlling the same.

BACKGROUND ART

Generally, the dryer is a home appliance for drying washed laundry, i.e., a drying object, mostly like clothes, with hot air. In general, the dryer is provided with a drum for holding the clothes, a driving source for driving the drum, heating means for heating air to be introduced to the drum, and a blower unit for drawing in or discharging air from the drum.

Based on methods for heating the air, i.e., the heating means, there may be electric type dryers, and gas type dryers. The electric type dryer heat the air with heat from electric resistance, and the gas type dryer heats the air with heat of burning gas. If the dryers are classified in another fashion, there may be condensing type (circulating type) dryers, and exhaust type dryers. In the condensing type dryer, air which becomes humid as a result of heat exchange with the clothes in the drum is not discharged to an outside of the dryer, but circulated in the dryer, and heat exchanged at a separate condenser to form condensed water which is discharged to an outside of the dryer. In the exhaust type dryer, the air which becomes humid as a result of heat exchange with the clothes at the drum is discharged to an outside of the dryer, directly. If the dryers are classified in another fashion, there may be top loading type dryers and front loading type dryers based on methods for loading the clothes into the dryer. In the top loading type dryers, the clothes is introduced into the dryer from a top side, and in the front loading type dryers, the clothes is introduced into the dryer from a front side.

The related art dryer has the following problems.

In general, washed and dehydrated laundry is introduced to the dryer for drying. However, in view of water washing principle, it is inevitable that the laundry is wrinkled during a washing cycle, and the wrinkles are not eliminated in a course of drying, perfectly. Consequently, in order to eliminate the wrinkles from the laundry, separate ironing has been required.

Moreover, besides the washed laundry, in cases clothes are stored, and used conventionally, wrinkles, rumples, folds, and the like (called as wrinkles collectively) are formed. Accordingly, development of a device for easy removal of the wrinkles caused by such conventional use, and storage of clothes is required.

DISCLOSURE OF INVENTION

Technical Problem

To solve the problems, an object of the present invention is to provide a dryer, and a method for controlling the same which can prevent and/or remove wrinkles from clothes, or the like.

Technical Solution

To achieve these objects and other advantages and in accordance with the purpose of the invention, as embodied and broadly described herein, a dryer including a selectably rotatable drum, a hot air heater for heating air to supply hot air to the drum, a steam generator for generating steam to supply the steam to the drum, and a water supply source for supplying water to the steam generator. Preferably, the water supply source is separate from a water tap, and more preferably, the water supply source is detachable.

Preferably, the dryer further includes a pump between the water supply source and the steam generator, and more preferably, the pump is reversible.

Preferably, the water is supplied through a lower part of the steam generator.

In the meantime, preferably the water supply source is placed in a drawer and more preferably, the drawer is mounted to a front of the dryer.

In the meantime, a steam flow passage is connected to the steam generator for spraying steam to the drum, and further includes a safety valve at a predetermined location of the steam flow passage for discharging the steam to an outside of the steam generator.

In the meantime, preferably, the water supply source has an opening/closing member provided thereto for selective discharge of the water from the water supply source. Preferably, the opening/closing member includes a flow passage in communication with the water supply source, and a pin for selective opening/closing of the flow passage, wherein the pin has one tapered end. Preferably, the flow passage of the opening/closing member has an O-ring on an outside surface of a fore end of one side.

In the meantime, a steam flow passage is connected to the steam generator for spraying the steam to the drum, wherein the steam flow passage has a fore end mounted adjacent to an opening portion through which the hot air is supplied to the drum.

In another aspect of the present invention, a dryer includes a selectably rotatable drum, a hot air heater for heating air to supply hot air to the drum, a steam generator for generating steam to supply the steam to the drum, and at least one filter for filtering the water. Preferably, the filter is a combination of a plurality of filters having different filtering capabilities. Moreover, the dryer further includes a water softening member for softening water being supplied to the steam generator.

In the meantime, preferably, the water supply source which supplies water to the steam generator is detachable. Preferably, the water supply source includes a lower housing, and an upper housing detachable from the lower housing. Preferably, a first filter is mounted in the upper housing. Preferably, an opening/closing member is provided in the lower housing for selective supply of water from the water supply source to an outside of the water supply source, and a second filter is provided in the opening/closing member, and more preferably, the second filter is detachable.

In the meantime, the water supply source further includes a water softening member mounted therein for softening the water, and preferably, the water softening member is detachable. Preferably, the water softening member includes a lower housing, a detachable upper housing, and ion exchange resin provided in a space defined with the upper housing and the lower housing.

In another aspect of the present invention, a method for controlling a dryer includes a water supply step for supplying water to a steam generator for generating steam, a water drain step for draining water in the steam generator. Preferably, the water drain step is performed by a pump. Preferably, the water in the steam generator is drained to the water supply source in the water drain step.

In the meantime, preferably, the water drain step is performed when a water temperature of the steam generator is lower than a preset temperature. Preferably, water is supplied to the steam generator in the water drain step, when the water temperature of the steam generator is higher than a preset temperature.

In the meantime, preferably, the steam generator is put operated, after the water supply step is finished. Preferably, the water supply step includes the steps of supplying water to the steam generator if the steam generator has a low water level, and stopping the water supply to the steam generator if the steam generator has a high water level. Preferably, the water supply step includes the step of supplying water to the steam generator for a predetermined time period if the steam generator has a low water level.

Advantageous Effects

Thus, the present invention enables effective prevention of formation of wrinkles on clothes and/or removal of wrinkles from clothes.

BRIEF DESCRIPTION OF THE DRAWINGS

FIG. 1 illustrates an exploded perspective view of a dryer in accordance with a preferred embodiment of the present invention;

FIG. 2 illustrates a longitudinal section of the dryer in FIG. 1;

FIG. 3 illustrates a section of a steam generator in FIG. 1;

FIG. 4 illustrates a diagram of a dryer in accordance with a preferred embodiment of the present invention shown focused on a steam generator;

FIG. 5 illustrates an exploded perspective view of one example of the water supply source in FIG. 4;

FIG. 6 illustrates an exploded perspective view of the water softening member in FIG. 4;

FIGS. 7 to 9 each illustrates a partially cut-away perspective view of the water softening member in FIG. 5;

FIG. 10 illustrates a side view of a connection between the water supply source and the pump in FIG. 4;

FIGS. 11 and 12 illustrate sections showing connection/disconnection of the water supply source in succession;

FIG. 13 illustrates a perspective view of a variation of the pin in FIG. 11;

FIG. 14 illustrates a section of another embodiment of the connection between the water supply source and the pump in FIG. 4;

FIG. 15 illustrates a section of an example of the pump in FIG. 4, schematically;

FIG. 16 illustrates a section of an example of the nozzle in FIG. 4;

FIGS. 17 and 18 illustrate a section and a perspective view of other examples of the nozzle in FIG. 4, respectively;

FIGS. 19 and 20 illustrate a section and a perspective view of other examples of the nozzle in FIG. 4, respectively;

FIG. 21 illustrates a front view of an example of mounting of the nozzle in FIG. 4;

FIGS. 22 and 23 illustrate sections respectively showing an example of the safety valve in FIG. 4, schematically;

FIG. 24 illustrates a perspective view showing an example of mounting of the unit in FIG. 4;

FIG. 25 illustrates a perspective view of other example of the water supply source in FIG. 4;

FIG. 26 illustrates a diagram showing an embodiment of a method for controlling a dryer in accordance with a preferred embodiment of the present invention; and FIG. 27 illustrates a flow chart showing the steps of a method for controlling a pump in FIG. 26.

BEST MODE FOR CARRYING OUT THE INVENTION

Reference will now be made in detail to the specific embodiments of the present invention, examples of which are illustrated in the accompanying drawings.

In order to describe a dryer and a method for controlling the same of the present invention, a top loading type, electric type, and exhaust type dryer will be taken as an embodiment for the sake of convenience. However, the present invention is not limited to this, but the present invention is applicable to front loading type, gas type, and condensing type dryers, too.

A dryer and a method for controlling the same in accordance with a preferred embodiment of the present invention will be described with reference to FIGS. 1 and 2.

Inside of a cabinet 10 which forms an exterior of the dryer, there are a rotatable drum 20, a motor 70 and a belt 68 for driving the drum 20. Mounted at a pre-determined location of the cabinet 10, there are a heater 90 (will be called as hot air heater) for heating air to produce high temperature air (will be called as hot air), and a hot air supply duct 44 for supplying the hot air from the hot air heater 90 to the drum 20. And, an exhaust duct 80 for discharging humid air in the drum 20 and a blower unit 60 blowing the humid air are also mounted. In the meantime, mounted at a pre-determined location of the cabinet 10, there is a steam generator 200 for generating hot steam. For convenience sake, in the embodiment, though the present invention is shown and described based on an indirect drive type in which the drum 20 is rotated by using the motor 70 and the belt 68, the present invention is not limited this, but the present invention is also applicable to a direct drive type in which the drum 20 is rotated directly by a motor directly connected to a rear of the drum 20.

Respective units of the dryer will be described in detail.

The cabinet 10 which forms an exterior of the dryer includes a base 12 which forms a bottom of the dryer, one pair of side covers 14 mounted to the base 12 vertically, a front cover 16 and a rear cover 18 mounted to a front and a rear of the side covers 14 respectively, and a top cover 17 located on top of the side covers 4. A control panel 19 with various operation switches is conventionally located on the top cover 17 or the front cover 16. The rear cover 18 has an inlet 182 for introduction of external air, and an exhaust hole 184 which is a final passage for discharging the air from the drum 20 to an outside of the dryer.

An inside space of the drum 20 serves as a drying chamber for drying the clothes, and, it is preferable that lifts 22 are provided in the drum 20 for lifting and dropping clothes, to turn the clothes upside down for enhancing drying efficiency.

In the meantime, mounted between the drum 20 and the cabinet 10, i.e., between the drum 20 and the front cover 16, there is a front supporter 30, and mounted between the drum 20 and the rear cover 18, there is a rear supporter 40. Rotatably mounted between the front supporter 30 and the rear supporter 40, there is the drum 20, and mounted between the front supporter 30 and the rear supporter 40 and the drum 20, there are sealing members (not shown) for preventing leakage. That is, the front supporter 30 and the rear supporter 40 cover the front and rear of the drum 20 to form the drying chamber, and support the front and rear of the drum 20, respectively.

The front supporter 30 has an opening to make the drum 20 to be in communication with an outside of the dryer, and the opening has a door 164 for selective opening/closing. The front supporter 30 also has a lint duct 50 connected thereto, which is a passage of the air from the drum 20 to an outside of the dryer, with a lint filter 52 mounted thereto. The blower unit 60 has one side connected to the lint duct 50, and the other side connected to the exhaust duct 80 which is connected to the exhaust hole 184 in the rear cover 18. Accordingly, if the blower unit 60 is operated, the air is discharged to an outside of the dryer from the drum 20 through the lint duct 50, the exhaust duct 80, and the exhaust hole 184. In this instance, foreign matters, such as lint, are filtered at the lint filter 52. In general, the blower unit 60 includes a blower 62 and a blower housing 64, and, in general, the blower 64 is driven by the motor 70 which also drives the drum 20. That is, in general, when the motor 70 is operated, both the blower unit 60 and the drum 20 are driven at the same time. Of course, individual driving of the blower unit 60 and the drum 20 is also possible.

The rear supporter 40 has an opening portion 42 having, in general, a plurality of pass through holes, with the hot air supply duct 44 connected thereto. The hot air supply duct 44 is in communication with the drum 20 for serving as a passage for supplying the hot air to the drum 20. Accordingly, the hot air heater 90 is mounted to a predetermined location of the hot air supply duct 44.

In the meantime, mounted to a predetermined location of the cabinet 10, there is the steam generator 200 for generating steam and supplying the steam to the drum 20. The steam generator 200 will be described in detail with reference to FIG. 3.

Mounted in the steam generator 200, there are a water tank 210 for holding water, a heater 240 mounted to an inside of the water tank 210, a water level sensor 260 for measuring a water level of the steam generator 200, and a temperature sensor 270 for measuring a temperature of the steam generator 200. In general, the water level sensor 260 includes a common electrode 262, a low water level electrode 264, and a high water level electrode 266 for sensing a high water level or a low water level based on electric connection between the common electrode 262 and the high water level electrode 264 or the common electrode 262 and the low water level electrode 266.

The steam generator 200 has one side connected to a water supply hose 220 for supplying water, and the other side connected to a steam hose 230 for discharging steam, and it is preferable that a predetermined shape of nozzle 250 is provided to a fore end of the steam hose 230. In general, one end of the water supply hose 220 is connected to an external water supply source, such as tap. The fore end or the nozzle 25 of the steam hose 230, i.e., a steam outlet is located at a predetermined location of the drum 20, for spraying the steam to an inside of the drum 20.

In the meantime, though the embodiment shows and describes a steam generator 200 (will be called as a tank heating type for convenience sake) in which an amount of water held in the water tank 210 of a predetermined size is heated with the heater 240 to generate the steam, the present invention is not limited to this. That is, the present invention can use any steam generator as far as the device can generate the steam. For an example, a configuration may also be used, in which a heater is mounted around a water supply hose through which water passes for heating the water without holding the water within a space (for convenience sake, will be called as tubular heating system).

A dryer in accordance with another preferred embodiment of the present invention will be described with reference to FIG. 4.

In the embodiment, the water supply source for supplying water to the steam generator 200 is separated from the tap. Alike the foregoing embodiment, the water supply source may be the tap, but in this case equipment becomes complicate. Because, in general since the dryer does not use water, if the tap is used as the water supply source, various devices for connecting the tap with the dryer is required additionally. Therefore, alike the embodiment, use of a water supply source separated from the tap is preferable, and one that is detachable is more preferable. This configuration is very convenient, since a water supply source 300 detached from the steam generator 200 can be filled with water and then the water supply source 300 can be connected to the water supply flow passage, of the steam generator 200, i.e., to the water supply hose 220. Of course, the water supply source may be designed not detachable from the steam generator 200, but the user may directly supply the water to the water supply source. In this case, it is preferable the water supply source 300 is connected to the steam generator 200 with a flexible tube, actually.

It is preferable that there is a pump 400 mounted between the water supply source 300 and the steam generator 200. It is more preferable that the pump 400 is reversible. In this case, it is possible to supply the water to the steam generator 200 and it is also possible to drain water in the steam generator 200. If necessary, it is also possible that the water may be supplied to the steam generator 200 by using a water head between the water supply source 300 and the steam generator 200 without using the pump. However, because, in general, components of the dryer are standard goods of compact design, there are shortages of mounting spaces. Therefore, if sizes of the components of the related art dryer are not changed, the water supply by using the water head may be impossible. Accordingly, as use of a small sized pump 400 enables mounting of the steam generator 200 without changing the sizes of the components, use of the pump 400 is very good. The remained water in the steam generator 200 is drained from the steam generator 200 to prevent the heater from damage caused by the remaining and unused water for a long time and to prevent use of rotten water, later.

Though the foregoing embodiment shows water supply to, and steam discharge from an upper part of the steam generator 200, in the embodiment, it is preferable that the water is supplied to a lower part of the steam generator 200 and the steam is discharged from the upper part of the steam generator 200. This configuration is favorable for draining the remained water from the steam generator 200.

It is preferable that a safety valve 500 is provided to the steam flow passage, i.e., the steam hose 230, which discharges steam from the steam generator 200.

Each of the units will be described in detail.

The detachable water supply source 300 (for convenience sake, will be called as a cartridge) will be described with reference to FIG. 5.

The cartridge 300 includes a lower housing 310 for substantially holding water, and an upper housing 320 detachable from the lower housing 310. The cartridge 300 with the lower housing 310 and the upper housing 320 enables easy cleaning of scale on an inside of the cartridge 300, and easy disassembly of the filter 330 and 340 and the water softening member 350 for cleaning or regeneration.

It is preferable that the upper housing 320 has a first filter 330 mounted thereto. That is, it is preferable that the first filter 330 is mounted to a water inlet to the upper housing 320, for firstly filtering the water when the water is supplied to the cartridge 300.

It is preferable that the lower housing 310 has an opening/closing member 360 provided thereto for selective supply of the water to an outside of the cartridge 300, so that the water is not discharged to an outside of the cartridge 300 when the cartridge 300 is separated, and the water is discharged to the outside of the cartridge 300 when the cartridge 300 is mounted. It is preferable that the opening/closing member 360 has a second filter 340 connected thereto for filtering the water, and it is more preferable that the second filter is detachable. The first filter 330 and the second filter 340 enable double filtering of impurities, such as fine dust, from the water. It is preferable that the first filter 330 has about 50 mesh net, and the second filter 340 has a 60 mesh net. The 50 mesh net has 50 meshes per unit area. Accordingly, a size of a mesh hole of the first filter 330 is greater than a size of the mesh hole of the second filter 340, such that larger foreign matters are filtered at the first filter 330 primarily, and smaller foreign matters are filtered at the second filter 340.

It is more preferable that the water softening member 350 is provided in the cartridge 300 for softening the water. It is more preferable that the water softening member 350 is detachable. As shown in FIG. 6, the water softening member 350 includes a lower housing 352 having a plurality of pass through holes, and a detachable upper housing 353 having a plurality of pass through holes, and preferably including ion exchange resin (not shown) filled in a space defined with the upper housing 353 and the lower housing 352.

The water softening member 350 is used under the following reason. When hardness of the water supplied to the steam generator 200 is high, if $Ca(HCO_3)_2$ dissolved in the water is heated, $CaCO_3$ deposits which is likely to corrode the heater. Particularly, the water in the Europe and the America has high hardness, such a phenomenon can be intensive. Therefore, it is preferable that calcium and magnesium are removed with the ion exchange resin, for preventing $CaCO_3$ from depositing. As performance of the ion exchange resin becomes poor as the ion exchange resin is used, the ion exchange resin may be regenerated with salt NaCl. For reference, a process for softening the water with the ion exchange resin is 2(R—SONa)+$Ca_2$(R—SO) Ca+2Na, and a process for regenerating the ion exchange resin is (R—SO) Ca+2NaCl 2(R—SONa)+CaCl.

Structures for mounting/dismounting the second filter 340 and the opening/closing member 360 will be described in detail with reference to FIGS. 7 to 9.

Mounted to the lower housing 310 of the cartridge 300 there is the opening/closing member 360 in communication with the cartridge 300. The opening/closing member 360 includes a flow passage 362 in communication with the cartridge 300, and a pin 365 for selective opening/closing of the flow passage 362. The flow passage 362 has an inner flow passage 362*a* and an outer flow passage 362*b*, and the inner flow passage 362*a* has a stopper 361 on an outside surface. The second filter 340 includes a case 341 with a shape in conformity with the inner flow passage 362*a*, and a filtering portion 344 at one side of the case 341. The case 341 has a slot 342 with a shape in conformity with the stopper 361. The slot 342 has an L shape substantially, i.e., a horizontal portion and a vertical portion. Therefore, after pushing the slot 342 of the second filter 340, more specifically, the horizontal portion, in a direction of the stopper 361 as shown in FIG. 8, if the second filter 340 is turned as shown in FIG. 9, coupling of the second filter 340 and the opening/closing member 360 is completed. Since dismounting of the second filter 340 from the opening/closing member is reverse of above, detailed description of which will be omitted Connection between the cartridge 300 and the pump 400 will be described in detail, with reference to FIG. 10.

Referring to FIG. 10, the cartridge 300 and the pump 400 are connected with an intermediate hose 490. The intermediate hose 490 has one side connected to the inlet 430 of the pump 400 and the other side connected to the cartridge with a connector 480. It is preferable that the inlet 430/the connector 480 of the pump 400 and the intermediate hose 490 are made to prevent leakage with clamps 492.

Connection between the cartridge 300 and the connector 480 will be described in detail with reference to FIGS. 11 and 13.

As described before, the cartridge 300 has the opening/closing member 360 in communication with the cartridge 300. The opening/closing member 360 includes the flow passage 362, and the pin 365 for selective opening/closing of the flow passage 362. The flow passage 362 has the inner flow passage 362*a* and the outer flow passage 362*b*, and the outer flow passage 362*b* has an O-ring 369 for sealing.

In the meantime, the pin 365 has a recessed portion 366 in one side of a body 365*b*, and a flowing portion 365*a* on the other side (See FIG. 13). An opening/closing portion 367 is mounted to the recessed portion 366, and the flowing portion 365*a* in a cross shape substantially for flow of water between the cross. It is preferable that the opening/closing portion 367 is formed of rubber.

The flow passage 362 will be described. Provided to an inside of the flow passage, there is a supporting portion having a plurality of pass through holes 363*a* formed therein for supporting the body 365*b*, and provided between the supporting portion 363*b* and the flowing portion 365*a* of the pin 365, there is a spring 364. The connector 480 has an outer portion 482 having an inside diameter greater than an outside diameter of the outer flow passage 362*b* of the opening/closing member 360, and an inner portion 484 having an outside diameter smaller than an inside diameter of the outer flow passage 362*b*.

Referring to FIG. 11, in a state the cartridge 300 is separated from the connector 480, the opening/closing member 367 on one side of the pin 365 closes a fore end of the inner flow passage 362*a* by the spring 364. Accordingly, no water flows to an outside from the cartridge 300 through the flow passage. However, as shown in FIG. 12, if the cartridge 300 is connected in the connector 480, the inner portion 484 of the connector 480 pushes the pin 365 forward in a direction of the inner flow passage 362*a* against elastic force of the spring 364. Accordingly, the opening/closing member 367 on one side of the pin 365 is moved away from the fore end of the inner flow passage 362*a*, permitting water to flow through a gap between the opening/closing member 367 and the fore end of the inner flow passage 362*a*, such that the water flows from the cartridge 300 toward an outside, i.e., toward the pump 400 through the flow passage. In the present invention, the double sealing with the O-ring 369 and the spring 364 enables effective prevention of leakage of the water.

Referring to FIG. 13, it is preferable that one end of the pin 365, i.e., an inside 366 of the flowing portion 365*a* is tapered, for providing a larger passage area of water flow compared to a simple cylindrical shape, for more effective flow of the water.

In the meantime, referring to FIG. 14, the cartridge 300 may be connected to the pump 400 directly without the intermediate hose 490. In this instance, it is required that a shape of an inlet 430*a* of the pump 400 is changed appropriately, i.e., an outer portion 432 and an inner portion 434 are formed. That is, a shape of the inlet 430*a* of the pump 400 is formed similar to the connector 480 in FIG. 11. In comparison to the connection in FIGS. 10 and 11, since above inlet shape permits to dispense with the intermediate hose 490 and the clamps 492 for sealing, material cost and man-hour can be saved. Moreover, a mounting space can be reduced.

In the meantime, the foregoing embodiment shows and describes a cartridge 300 with detachable first filter 330, second filter 340, and water softening member 350, the present invention is not limited to this. For an example, the present invention is applicable to a case when an external tap is used as the water supply source 300. in this case, it is preferable that at least one of the first filter 330, the second filter 340, and the water softening member 350 is mounted to the water supply flow passage connected to the steam generator 200, and more preferably, detachable ones in this case too. It is preferable that the first filter 330, the second filter 340, and the water softening member 350 are integrated into one container which is also detachable from the water supply flow passage.

The pump 400 will be described with reference to FIG. 15.

The pump 400 supplies water to the steam generator selectively. It is preferable that the pump 400 is reversible for selective supplying or draining of the water to/from the steam generator 200.

The pump 400 may be a gear type, pulsating type, diaphragm type, or so on. By changing a polarity of a circuit, the pulsating type, or diaphragm type pump can control a fluid flow direction in regular/reverse directions. As an example of an applicable pump 400, a gear type pump 420 is shown in FIG. 15. The gear type pump 400 has one pair of gears 420 in a case 410 having an inlet 430, 430*a*, and an outlet 414. That is, depending on a rotation direction of the gears 420, the water can be pumped in a direction from the inlet 430, 430*a* to the outlet 414, or from the outlet 414 to the inlet 430, 430*a*.

The nozzle 250 will be described in detail with reference to FIGS. 16 to 20.

Referring to FIG. 16, the nozzle 250 may have a general shape. That is, the nozzle 250 is formed in a shape of an enlarged-reduced tube, for spraying steam to the drum through a spray hole 251*a* formed in a fore end of the nozzle 250. It is preferable that the nozzle 250 has a supporting portion 259 for mounting the nozzle 250. As shown in FIG. 16, if the steam is simply sprayed through the spray hole 251*a* at the fore end of the nozzle 250, the wrinkle removal performance of the steam can be poor because the steam is sprayed to a limited portion of the drum by a kinetic energy of the steam. Therefore, it is preferable that the shape of the nozzle 250 is changed, appropriately.

Another embodiment of the nozzle 250 will be described with reference to FIGS. 17 and 18.

It is preferable that the nozzle 250 has a supplementary nozzle 253 on an inside of the nozzle 250. In this case, it is preferable that the nozzle 250 has a shape of which diameter is not varied, or is a reduced-enlarged tube. If the nozzle 250 is the reduced enlarged tube, it is preferable that the nozzle 250 has a diameter which becomes slightly greater at the fore end 251. It is preferable that the supplementary nozzle 253 has the reduced-enlarge shape, and a cone shape. It is preferable that an outward slope angle of the supplementary nozzle 253 is smaller than an outward slope angle of the nozzle 250. For an example, the nozzle 250 is sloped at 30 degrees outwardly, and the supplementary nozzle 253 is sloped at 15 degrees outwardly.

The foregoing configuration makes a diffusion angle of the steam greater, enabling uniform wetting of the clothes with the steam, to improve the wrinkle removal performance.

In the meantime, it is preferable that a connection portion 255 is provided for connecting the nozzle 250 to the supplementary nozzle 253. This configuration enables unitization of the nozzle 250, the supplementary nozzle 253, and the connection portion 255, which improves formation of a mold, and mass productivity.

In FIG. 18, unexplained reference numeral 259*a* denotes a fastening hole in the supporting portion.

Another embodiment of the nozzle 250 will be described with reference to FIGS. 19 and 20.

It is preferable that a vortex generating member is provided in the nozzle 250 for generating a vortex. In this case, it is preferable that the nozzle 250 has a shape of which diameter is constant, or a reduced-enlarged tube shape. If the nozzle 250 has the reduced-enlarged tube shape, it is preferable that the nozzle 250 has a fore end 251 with a slightly greater diameter.

It is preferable that the vortex generating member is a blade 257. Preferably, the blade 257 is an extension from an inside wall of the nozzle 250, with a curve. In this instance, though a plurality of blades 257 may be connected at a center of the nozzle 250 directly, it is more preferable that the nozzle 250 has a center member 258 in the nozzle 250, and the blades 257 are connected between the inside wall of the nozzle 250 and the center member 258. It is more preferable that the center member 258 has a flow passage 258*a* formed therein. This configuration can improve forming of a mold, and mass productivity.

Above configuration forms vortex of the steam to increase a kinetic energy and a diffusion angle, enabling the steam to wet the clothes uniformly, and improving a wrinkle removal performance.

In the meantime, referring to FIG. 21, it is preferable that the nozzle 250 is mounted adjacent to the opening portion 42 for spraying the steam from a rear to a front of the drum. Because in general the air is introduced into the drum through the opening portion 42 in the rear supporter 40 and escapes through the lint duct (not shown, see FIG. 1) under the door 104, an air flows from the opening portion 42 to the lint duct. Thus, if the nozzle 250 is mounted adjacent to the opening portion 42, the sprayed steam flows following the air flow smoothly, enabling the steam to wet the clothes, uniformly.

In the meantime, the nozzle 250 described in the embodiment is applicable to ones other than the dryer having a detachable water supply source 300. For an example, the nozzle 250 described in the embodiment is applicable to a case when an external tap is used as the water supply source 300.

The safety valve 500 will be described with reference to FIGS. 16, 22, and 23.

In a case the steam generator is operative normally, the steam is sprayed to the drum through the steam hose 230, and the nozzle 250. However, if fine fabric particles, such as lint or foreign matters formed in a clothes drying process, attach to and accumulate on the spray hole 251*a* of the nozzle 250 to block the spray hole 251*a*, the steam can not be discharged to the drum normally, but, oppositely, acts as a pressure to increase a pressure of the steam generator 200 itself, to damage the steam generator. Particularly, in a steam generator of tank heating type, in general since the water tank is not designed as a high pressure vessel which can withstand a high pressure, such a hazard is likely. Accordingly, it is preferable that an appropriate safety device is provided.

The safety valve 500 serves to discharge the steam to an outside of the steam generator if the steam flow passage is blocked. Therefore, it is preferable that the safety valve 500 is provided to the steam flow passage, for an example, the steam hose 230, and more preferably, in the vicinity of the fore end of the steam hose 230, for an example, adjacent to the nozzle 250.

The safety valve 500 includes a case 510 having one side in communication with the steam hose 230, and the other side in communication with an outside of the steam generator, and an opening/closing portion 530 for selective opening/closing of the case 510 and the steam hose 230. The opening/closing portion 530 is mounted to a steam flow passage communication portion 513 of the case 510, and the opening/closing portion 530 is supported by a spring 520. Of course, the spring 520 has one side supported on the opening/closing portion 530, and the other side supported on a fixed portion 540 fixed to the case 510 in a predetermined method.

Referring to FIG. 22, if a pressure of the steam hose 230 is below a predetermined pressure as the steam hose 230 is not blocked, the steam can not overcome elastic force of the spring 520. Therefore, the opening/closing portion 530 blocks the steam flow passage communication portion 513, resulting in no steam discharge to the outside of the steam generator. However, as shown in FIG. 23, if the steam hose 230 is blocked, to cause the pressure of the steam hose 520 higher than a predetermined pressure, for an example, 1 kgf/$cm^2$, the steam pressure overcomes the elastic force of the spring 520. According to this, the opening/closing portion 530 that blocks the steam flow passage communication portion 513 moves, allowing the steam to be discharged to the outside of the steam generator through the steam flow passage communication portion 513 and an outside communication portion 511.

Mounting of components of a steam line, mainly the steam generator, in accordance with a preferred embodiment of the present invention will be described with reference to FIG. 24.

It is preferable that a drawer type container 700 (will be called as a drawer) which can be pushed in/pulled out at a predetermined location of the dryer is provided. It is also preferable that the cartridge 300 is placed in the drawer 700. That is, rather than connecting the cartridge 300 to the connector 480 directly, it is preferable that the cartridge 300 is placed in the drawer 700, and the drawer is pushed in/pulled out so that the cartridge 300 is connected/disconnected to/from the connector 480.

It is preferable that the drawer 700 is provided to the front of the dryer, for an example, to the control panel 19. In detail, a supporter 820 is provided on a rear side of the control panel 19. That is, it is preferable that the supporter 820 is mounted parallel to the top frame 830 substantially, and a drawer guide 710 is mounted to the supporter 820 and the top frame 830 for guiding and supporting the drawer 700, and it is more preferable that a top guide 810 is provided to a portion of an upper portion of the drawer guide 710.

More preferably, the drawer guide 710 has opened upper portion and one side (on a front side of the dryer), so that the drawer 700 is pushed in/pulled out through the opened one side, and the connector 480 is provided to an upper portion of the other side of the drawer guide 710.

As described before, it is preferable that the drawer 700 is mounted to the front of the dryer in view of convenience of use of the dryer. As FIG. 24 illustrates a dryer in which the control panel 19 is mounted to a front cover, the drawer 700 being pushed in/pulled out of the control panel 19 has been described. However, the present invention is not limited to this, for an example, if the control panel is mounted to a top cover as shown in FIG. 1, the drawer 700 may be mounted to the front cover, directly.

In the meantime, the cartridge 300 is placed in the drawer 700, it is preferable that at least shapes of opposite sides of the cartridge 300 are in conformity with shapes of opposite sides of the drawer 700, so that the cartridge 300 is fastened to the drawer 700, closely. It is preferable that recesses 301 are formed in opposite sides of the cartridge 300 for mounting/dismounting of the cartridge 300.

A method for supplying water to the cartridge 300 will be described with reference to FIG. 24.

When the user pulls out the drawer 700, the cartridge 300 is also pulled out. In this state, the cartridge 300 is dismounted from the drawer 700. Water is supplied to the dismounted cartridge 300 through a water supply hole, for an example, the first filter 330, to fill the cartridge 300 with water. The cartridge 300 having the water filled therein is mounted to the drawer 700 again, and then, if the drawer 700 is pushed in, the cartridge 300 and the connector 480 are connected automatically, opening the water in the cartridge 300 to the pump 400.

After finishing the operation of the dryer, the cartridge 300 can be dismounted from the drawer 700 in steps opposite to above description. Since the cartridge 300 of the present invention has the upper housing 320 and the lower housing 310, cleaning of dismounted cartridge 300 is easy.

In the meantime, referring to FIG. 25, it is also possible that the drawer 700 is directly used as a water supply source. However, in a case the drawer 700 is directly used as the water supply source, the water can overflow from the drawer 700 at the time of water supply due to negligence of the user, if the cartridge 300 is used as the detachable water supply source as described before, such a problem can be prevented to a certain extent. The case when the drawer 700 is used as a direct water supply source is advantageous in that a structure of the steam generator can be made simple. Though FIG. 25 illustrates that only the water softening member 350 is placed in the drawer 700 for convenience sake, the first filter 330 and the second filter 340 may also be placed therein.

A method for controlling a dryer in accordance with a preferred embodiment of the present invention will be described with reference to FIGS. 26 and 27.

There may be two kinds of methods for operating the dryer in the present invention. That is, a drying operation, i.e., an operation for drying clothes, which is an original function of a general dryer and an operation of the present invention, i.e., an operation which can remove wrinkles from the clothes (for convenience sake, will be called as a refresh operation). By the refresh operation, not only the removal of the wrinkle, but also functions, such as sterilizing, deodoring, prevention of static electricity, fluffiness of the clothes, and so on, can be made. Because the method for controlling a dryer for the drying operation includes a hot air supplying step and a cooling step, and has been used in the related art, detailed description of which will be omitted. The method for controlling a dryer for the refresh operation includes a steam supply step especially, which will be described in detail.

The method for controlling a dryer for the refresh operation includes a steam supplying step (SS5) for supplying steam to a drum, and a hot air supplying step (SS7) for supplying hot air to the drum. It is preferable that the method includes a drum heating step (SS3) for heating the drum before the steam supplying step (SS5). Moreover, the method also includes a water supplying step (SS1) for supplying water to the steam generator for generating the steam required in the steam supplying step (SS5).

It is preferable that the water supplying step (SS1) is performed before the drum heating step (SS3), and it is preferable that a cooling step (SS9) is further included for cooling the drum after the hot air supplying step (SS7). It is preferable that the present invention further includes a water draining step for discharging water remained in the steam generator, i.e., remained water, to an outside of the steam generator after finish of the steam supplying step (SS5). (Detailed water draining step will be described later.) Though the drum heating may be performed with a separate heater mounted to an inside of the drum, use of the hot air heater is simple.

Respective control steps will be described in detail.

In the drum heating step SS3, the drum is heated to a predetermined temperature for making a wrinkle removal effect to be performed in the next steam supply step SS5 more effective. The drum heating step SS3 is performed for a predetermined period T_pre-T_pump. In this instance, it is preferable that the drum is rotated, preferably, tumbled, and more preferably, tumbled, intermittently. The tumbling is rotation of the drum around a speed below 50 rpm, so that the clothes do not stick to an inside wall of the drum, detailed description of which will be omitted because the tumbling is apparent in the field of the art. It is preferable that the drum heating step SS3 is started after the water is supplied to the steam generator for a predetermined time period T_pump to a high water level of the steam generator. It is preferable that the steam heater is put into operation at a time point when the drum heating step SS3 is started, because the steam is generated after lapse of a predetermined time period even if the steam heater starts operation. Moreover, it is preferable that finish of the drum heating step SS3 is substantially coincident with the time point the steam is generated. Because the drum can be kept heated after the steam is generated, i.e., an actual steam supply step SS5, the inside of the drum will be in an excessively high temperature environment enough to gasify the steam supplied thereto, such that there is no steam in the drum.

The steam supply step SS5 is a step for supplying the steam to the drum to perform the wrinkle removing function. The steam supply step SS5 is performed for a pre-determined time period T_steam. In this instance, it is preferable that the drum is rotated, preferably, tumbled, and more preferably, tumbled, intermittently. It is preferable that a time period T_steam of the steam supply step SS5 is set in advance by experiments or the like based on factors, such as an amount of the clothes. Since the water level of the steam generator is reduced in the steam supply step SS5, it is preferable that water is supplied if a low water level is sensed. In this instance, even though the water may be supplied up to a high water level, it is preferable that the water is supplied for a predetermined time period before the water level reaches to the high water level, for an example, for about three seconds for effective heating. If the water is supplied to the high water level, the supply of steam stops for a predetermined time period due to heating a large amount of water to a boiling temperature. However, if the water is supplied for the predetermined time period, for an example, three seconds, enabling to generate the steam after about one second, the steam can be supplied to the drum, almost continuously.

It is preferable that the tumbling in the steam supply step SS5 is made intermittently, and periodically repeated, for an example, repeated for three seconds in every one minute. Even though the tumbling of the drum can be kept in the steam supply step SS5, in this case the steam supplied to the drum can be discharged to an outside of the drum without staying in the drum. Because in general the blower unit and the drum are driven with one motor, if the drum is rotated, the blower also is driven, to discharge the steam from the drum to an outside of the drum. Accordingly, in the steam supply step SS5, it is preferable that the drum is rotated intermittently, preferably a rotation time period of the drum is shorter than a pause time period of the drum. Moreover, according to study of the inventor, even though a location of the clothes in the drum is changed during the rotation of the drum, if the drum is stopped, the clothes is located at a lower portion of a front side of the drum substantially, i.e., in the vicinity of the door. Since change of a spray direction of the nozzle is not easy, the nozzle is fixed directed to the lower portion of the front side of the drum. Accordingly, it is preferable that the clothes are placed in the spray direction of the nozzle, i.e., at the lower portion of the front of the drum. Accordingly, in view of absorbing the steam in the clothes, it is preferable that the rotation of the drum is made for a short time period in the steam supply step SS5, so that the clothes is placed in the nozzle spray direction for a longer time period.

In the hot air supply step S7, the hot air generated by the hot air heater is supplied to the drum, for drying the slightly wet clothes with the steam again. The hot air supply step SS7 is performed for a predetermined time period T_dry, preferably without tumbling the drum. It is preferable that the time period T_dry of the hot air supply step SS7 is set in advance determined by experiments based on factors, such as an amount of the clothes. It is preferable that, after the steam supply step SS5, the remained water in the steam generator is discharged to the cartridge, again. In this instance, it is preferable that, because the remained water in the steam generator has a high temperature, the remained water is not discharged directly, but delayed for a pre-determined time period T_delay, and discharged when the temperature of the steam generator is below a predetermined temperature Temp_crit. (details will be described, later)

In the cooling step SS9, the clothes having a temperature thereof elevated in the hot air supply step SS7 is cooled down again. The cooling step SS9 is performed for a pre-determined time period T_cooling, preferably without tumbling the drum. It is preferable that the time period T_cooing of the cooling step SS9 is set in advance determined by experiments based on factors, such as an amount of the clothes. Even though cold air can be supplied to the clothes in the cooling step SS9, since a temperature of the clothes is not high relatively, leaving the clothes as it is for a pre-determined time period is a simple method and preferable.

A method for controlling the pump will be described with reference to FIGS. 26 and 27.

The method for controlling the pump of the present invention includes a water supply step S100, and S200 for supplying water to the steam generator, and a water drain step S300 for draining the remained water in the steam generator. Of course, it is preferable that the water supply step S100, S200 includes an initial water supply step S100 and a water level maintaining step S200 for maintaining a water level of the steam generator. In the meantime, it is preferable that the water drain step S300 is performed by the pump, and more preferably the water is drained to the detachable water supply source connected to the steam generator.

Respective steps will be described in detail.

As described before, preferably, the water supply step S100, S200 includes the initial water supply step S100, and the water level maintaining step S200 for maintaining a water level of the steam generator. The pump rotates in a regular (forward) direction for supplying the water to the steam generator (S1). It is preferable that, if the water level of the steam generator becomes a high level (S3), the pump stops, and the steam heater is put into operation (S5).

If the water is heated to generate the steam as the steam heater is operated, and the generated steam is discharged, the water level of the steam generator is reduced. If the water level of the steam generator becomes the low water level, the pump is rotated in the forward direction, to supply the water to the steam generator. (S9, and S11). In this instance, as described before, though the water may be supplied until the high water level is sensed, in view of heating efficiency, it is preferable that the water is supplied for a predetermined time period, for an example, three seconds.

In the meantime, if a predetermined steam supply time period T_steam is passed (S7), the steam heater is stopped (S13) and a predetermined time period T_delay is delayed (S15). The predetermined time period T_delay is delayed for lowering the temperature of the remained water in the steam generator. Then, if the temperature of the steam generator is lower than a safe temperature Temp_crit (S17), the pump is rotated in a reverse (backward) direction, for a predetermined time period, for an example, about 30 seconds, to recover the remained water in the steam generator (S25). However, if the temperature of the steam generator is higher than the safe temperature Temp_crit, the remained water is not drained from the steam generator directly, but a safety precaution is taken. For an example, it is determined whether the water level of the steam generator is lower than the high water level (S19). If the water level of the steam generator is lower than the high water level, the pump is rotated in the regular direction for a predetermined time period, for an example, about 5 seconds, to supply the water to the steam generator, again (S21). If the water level of the steam generator is not lower than the high water level, the temperature of the steam generator is compared to the safe temperature (S23). If the temperature of the steam generator is lower than the safe temperature Temp_crit (S23), the pump is rotated in the reverse direction for a predetermined time period, for an example, about 30 seconds, the remained water is drained from the steam generator (S25). However, if the temperature of the steam generator is higher than the safe temperature Temp_crit, the pump is not rotated in the reverse direction, but stopped (S27). Of course, the temperature may be compared after a predetermined time period, to drain the remained water if requirement is satisfied. The safe temperature Temp_crit could be the highest temperature at which reliability of the pump can be maintained, for an example, approx. 60 degrees.

FIGS. 26 and 27 shows the water supply time period T_pump, the steam generating preparation time period T_pre, the steam supply time period T_steam, the drying time period T_dry, the cooling time period T_cooling, the delay time period T_delay, the tumbling time period, the pump operation time period, and so on which are examples. These factors such as time can be changed appropriately according to a capacity of the dryer, an amount of the clothes, and the like.

According to an experiment result by the inventor, though there are differences depending on kinds of fabric, and extents of water absorption, the refresh operation of the present invention has a wrinkle removal and prevention effect. As an example of the clothes washed and dehydrated in a washing machine is explained, the clothes are not limited to these. For an example, small wrinkles on clothes already in a dried state such as clothes wore for about during a day can be removed in the dryer of the present invention, which can be especially useful. That is, as a kind of wrinkle removal appliance, the dryer of the present invention may be used.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

The dryer and the method for controlling the same of the present invention has the following advantages.

First, wrinkles or rumples of clothes in the dryer can be prevented or removed. Moreover, clothes can be sterilized, or deodored.

Second, wrinkles or rumples can be removed from clothes of a dried state without separate ironing, effectively.

The invention claimed is:

1. A dryer comprising:
- a cabinet;
- a selectably rotatable drum;
- a hot air heater to heat air to supply hot air to the drum;
- a steam generator to generate steam to supply to the drum; and
- a water supply source to supply water to the steam generator,
- wherein the water supply source is separate from a water tap,
- wherein the water supply source is detachably placed in a drawer,
- wherein the drawer is mounted on a control panel displaced on a upper part of the front cover of the dryer,
- wherein the drawer is pushed in/pulled out of the control panel, and
- wherein when the drawer is pulled out of the control panel, the one end of the drawer is supported by the cabinet and the water supply source in the drawer is separable from the drawer.

2. The dryer as claimed in claim 1, further comprising:
- a pump between the water supply source and the steam generator.

3. The dryer as claimed in claim 2, wherein the pump is reversible.

4. The dryer as claimed in claim 3, wherein the water is supplied through a lower part of the steam generator.

5. The dryer as claimed in claim 1, wherein a steam flow passage is connected to the steam generator to spray steam to the drum, and further includes a safety valve at a predetermined location of the steam flow passage for discharging the steam to an outside of the steam generator.

6. The dryer as claimed in claim 1, wherein the water supply source has an opening/closing member provided thereto for selective discharge of the water from the water supply source.

7. The dryer as claimed in claim 6 wherein the opening/closing member includes a flow passage in communication with the water supply source, and a pin for selective opening/closing of the flow passage, wherein the pin has one tapered end.

8. The dryer as claimed in claim 6 wherein the flow passage of the opening/closing member has an O-ring on an outside surface of a fore end of one side.

9. The dryer as claimed in claim 1, wherein a steam flow passage is connected to the steam generator to spray the steam to the drum, wherein the steam flow passage has a fore end mounted adjacent to an opening portion through which the hot air is supplied to the drum.

10. A dryer comprising:
- a cabinet;
- a selectably rotatable drum;
- a hot air heater to heat air to supply hot air to the drum;
- a steam generator to generate steam to supply hot steam to the drum; and a water supply source to supply water to the steam generator, wherein the source is separate from a water tap and has a filter for filtering the water being supplied to the steam generator, wherein the water supply source is detachably placed in a drawer, wherein the drawer is mounted on a control panel displaced on a upper part of the front cover of the dryer, wherein the drawer is pushed in/pulled out of the control panel, and wherein when the drawer is pulled out of the control panel, one end of the drawer is supported by the cabinet and the water supply source in the drawer is separable from the drawer.

11. The dryer as claimed in claim 10, wherein the filter is a combination of a plurality of filters having different filtering capabilities.

12. The dryer as claimed in claim 10, wherein the at least one filter is a water softening member for softening water.

13. A dryer comprising:

a selectable rotatable drum;

a hot air heater to heat air to supply hot air to the drum;

a steam generator to generate steam to supply hot steam to the drum;

a water supply source to supply water to the steam generator, the water supply source is separate from a water tap, wherein the water supply supply source is detachable placed in a drawer, the drawer is mounted on a control panel displaced on an upper part of the front cover of the dryer, and the drawer is pushed in/pulled out of the control panel the water supply source comprising a lower housing and an upper housing detachable from the lower housing; and at least one filter to filter the water being supplied to the steam generator, wherein a first filter is mounted in the upper housing.

14. The dryer as claimed in claim 13, wherein an opening/closing member is provided in the lower housing for selective supply of water from the water supply source to an outside of the water supply source, and a second filter is provided in the opening/closing member.

15. The dryer as claimed in claim 14, wherein the second filter is detachable.

16. The dryer as claimed in claim 12, wherein the water softening member is placed in the water supply source.

17. The dryer as claimed in claim 16, wherein the water softening member is detachable.

18. The dryer as claimed in claim 17, wherein the water softening member includes;

a lower housing, a detachable upper housing, and ion exchange resin provided in a space defined with the upper housing and the lower housing.

19. A dryer comprising:

a cabinet;

a selectably rotatable drum;

a hot air heater to heat air to supply hot air to the drum;

a steam generator to generate steam to supply into the drum;

a water supply source to supply water to the steam generator; and a pump to pump water to the steam generator, wherein the water supply source is detachably placed in a drawer, wherein the drawer is mounted on a control panel displaced on an upper part of the front cover of the dryer, wherein the drawer is pushed in/pulled out of the control panel, and wherein when the drawer is pulled out of the control panel, one end of the drawer is supported by the cabinet and the water supply source in the drawer is separable from the drawer.

20. The dryer as claimed in claim 19, further comprising a controller to control the pump based on time.

21. The dryer as claimed in claim 20, wherein the controller controls repeated operation of the pump.

22. The dryer as claimed in claim 21, wherein an operation time and a non-operation time of the pump are predetermined respectively.

23. The dryer as claimed in claim 20, wherein the controller varies a total operation time of the pump according to an amount of laundry.

24. The dryer as claimed in claim 19, wherein the dryer further comprises a sensor to sense a water level of the steam generator and the pump is controlled according to the sensed water level.

* * * * *